US006561350B1

(12) United States Patent
Ueno

(10) Patent No.: US 6,561,350 B1
(45) Date of Patent: May 13, 2003

(54) STICKING DEVICE

(75) Inventor: Hideyuki Ueno, Kanagawa (JP)

(73) Assignee: Kotec's Co., Ltd., Tokyo (JP)

( * ) Notice: Subject to any disclaimer, the term of this patent is extended or adjusted under 35 U.S.C. 154(b) by 0 days.

(21) Appl. No.: 09/673,351

(22) PCT Filed: Feb. 18, 2000

(86) PCT No.: PCT/JP00/00945

§ 371 (c)(1),
(2), (4) Date: Nov. 29, 2000

(87) PCT Pub. No.: WO00/48912

PCT Pub. Date: Aug. 24, 2000

(30) Foreign Application Priority Data

Feb. 18, 1999 (JP) ..... 11/039473

(51) Int. Cl.[7] ..... B65D 85/24
(52) U.S. Cl. ..... 206/343; 206/345; 206/820
(58) Field of Search ..... 206/338, 343–346, 206/820; 24/16 PB, 30.5 P, 704.2; 292/321, 322, 318, 319

(56) References Cited

U.S. PATENT DOCUMENTS 3,516,124 A * 6/1970 Merser ..... 24/16 PB
3,712,655 A * 1/1973 Fuehrer ..... 24/16 PB
3,942,750 A * 3/1976 Noorily ..... 24/16 PB
4,092,765 A * 6/1978 Joyce ..... 24/16 PB
4,235,404 A * 11/1980 Kraus ..... 24/16 PB
4,502,186 A * 3/1985 Clarke et al. ..... 24/16 PB
4,730,615 A * 3/1988 Sutherland et al. ..... 24/16 PB
5,333,361 A * 8/1994 Schaede ..... 24/16 PB
5,908,110 A * 6/1999 Hirai ..... 206/345

FOREIGN PATENT DOCUMENTS

GB 2103274 * 2/1983

* cited by examiner

*Primary Examiner*—Luan K. Bui
(74) *Attorney, Agent, or Firm*—Young & Thompson

(57) ABSTRACT

A sealing implement has a plurality of single sealing implements having a flexible filament part, an insertion head part having an appropriate engaging part provided on one end part of the filament part, and a socket part having a hole for the purpose of irreversibly inserting the insertion head part provided on the other end of the filament, the arrangement of the plurality of single sealing implements being made so that the filament parts thereof are mutually parallel and adjacent, each of the plurality of insertion head parts, or socket parts in proximity thereto, or parts thereof being caused to be connected to separately provided connection bar parts and a filament part of the unit of sealing implement showing curvilinear configuration or at least one portion of said filament part thereof provided with a folded portion.

21 Claims, 13 Drawing Sheets

STICKING DEVICE

BACKGROUND OF THE INVENTION

1. Field of the Invention

The present invention relates to a sealing implement for sealing by affixing a tag such as a brand label, price tag, material explanation, or handling instructions to a product such as a garment, shoes, or bag, and more particularly it relates to a sealing implement capable of performing an operation of smoothly affixing a tag when the above-noted tag is set into a special attachment apparatus (gun).

2. Description of Related Art

Various sealing implements have been proposed in the past as shown in FIG. 27, for the general bundling of articles such as garments, women's boots, sandals, and bags and shoes, or for affixing to such products a brand label, price tag or the like.

In FIG. 27, for example, such an implement can have a configuration formed by a filament 5 forming a loop that is passed through a tag, an insertion head part 6 formed on one end the filament 5 and a socket part 8 having an insertion hole 7 for the purpose of passing the insertion head part 6, provided on the other end of the filament 5.

A plurality of single sealing implements which forming an unit of sealing implement 4 are temporarily attached to two mutually parallel connection bars 11 so as to enable removal therefrom.

An embodiment of the sealing implement as shown in FIG. 27, can be integrally formed of a synthetic resin, and in particular the filament part 5 thereof is drawn and exhibits extremely high strength with respect to pulling tension.

When the insertion head part 19 is inserted through a narrow portion 7 of the socket part, a pair of skirts 9 serving as hook portions and which being provided on the insertion head part 19, is opened and thereby the insertion head part 19 is irreversibly fixed inside the socket part 8, thereby completing the sealing, in a condition in which the label is affixed with the implement forming a loop.

In the past, such sealing implements were loaded into a special ejecting apparatus (attachment gun), a lever thereof being pulled, thereby enabling use chiefly in bundling of such items as boots, sandals, and shoes, and also in fixing of a price tag, or a tag T having instructions for use of the product to the product.

With an unit of sealing implements of the past as described above, however, since over-all configuration of the unit of sealing implements including a plurality of filament parts 5 is simply formed into a flat, and thus generally operator should have to bend a part of the filament part of the unit of sealing implements first so that the insertion head part and the socket part thereof are approached to each other and then the operator mounts same on the gun, this operation shows a various kinds of difficulty.

For example, the unit of sealing implements is to be mounted on a gun which is exclusively used for continuously sealing the sealing implement by operating a lever of the gun, the unit of sealing implements is to be bent with relatively strong force first and thereafter, the insertion head part 6 should be mounted on one end of the gun while the socket part 8 should be mounted on another end of the gun and this work was heavy work for the operator.

Further, in this case, it was very difficult for the operator to hold the shooting gun in one hand and to mount the unit of sealing implement on the gun with the opposite hand.

On the other hand, when the operator first bends a plurality of filament parts 5 which being mutually arranged in parallel with each other and thereafter mount it on the gun exclusively used for this unit of sealing implements and uses each one of the single filament part one by one, the bended portions each formed on a part of the filament part and adjacently arranged, is used to intermingle with each other causing to occur a jamming phenomena, in the gun.

Moreover, since an operator feels difficult in identifying a surface of the unit of sealing implement whether such surface is a front surface or a back surface when he tries to bend the filament parts forming a flat condition, there must be a case in which the operator would bend the unit of sealing implement in opposite direction so that the bended unit of sealing implement would erroneously be set in reverse condition causing it a result of malfunction of the gun.

Further more, when the filament part of the unit of sealing implement forming a flat condition is to be bended, the filament portion is relatively hard so that there must be a limitation in a radius of curvature to be set and thus a width of the gun cannot be significantly shortened.

Accordingly, it is a first object of the present invention to provide an unit of sealing implements which can improve the operational efficiency when an unit of sealing implements is mounted on the gun exclusively used for the unit of sealing implements as well as can prevent the unit of sealing implements from being intermingled to each other or from causing to occur the jam on the gun.

Further a second object of the present invention is to improve the operational characteristic of the unit of sealing implement when the single sealing implement is respectively attached to a commercial good.

SUMMARY OF THE INVENTION

To achieve the above-noted objects, the present invention adopts the following base technical constitution.

Specifically, a first aspect of the present invention is such that an unit of sealing implement comprising a plurality of single sealing implements each one of which comprising, a flexible filament part, an insertion head part having an appropriate engaging part provided on one end part of the filament part, and a socket part having a hole for the purpose of irreversibly inserting the insertion head part provided on another end of the filament, wherein a plurality of the single sealing implements are mutually and adjacently arranged in parallel with each other and each of the plurality of insertion head parts or a portion proximity thereto and each of the plurality of socket parts or a portion proximity thereto being caused to be connected to separately provided connecting bars, and further wherein a filament part of the unit of sealing implement showing curvilinear configuration or at least one portion of the filament part thereof provided with a folded portion.

A second aspect of the present invention is such that an unit of sealing implement comprising a plurality of single sealing implements each one of which comprising, a flexible filament part, an insertion head part having an appropriate engaging part provided on one end part of the filament part, and a socket part having a hole for the purpose of irreversibly inserting the insertion head part provided on another end of the filament, wherein a plurality of the single sealing implements are mutually and adjacently arranged in parallel with each other and each of the plurality of insertion head parts or a portion proximity thereto and each of the plurality of socket parts or a portion proximity thereto being caused to be connected to separately provided connecting bars, and further wherein at least a part of the filament part of the unit of sealing implement being provided with a filament deforming mechanism which can easily deform the filament part into a curvilinear or folded configuration, irreversibly.

A third aspect of the present invention is such that a single sealing implement which comprising, a flexible filament part, an insertion head part having an appropriate engaging part provided on one end part of the filament part, and a socket part having a hole for the purpose of irreversibly inserting the insertion head part provided on another end of the filament, wherein at least a part of the filament part being provided with a bended portion at which the part of the filament part being irreversibly curved or bended into a predetermined configuration, and further wherein, both of the filament part connected to the socket part and the filament part connected to the insertion head part substantially showing linear configuration, respectively.

A fourth aspect of the present invention is such that an unit of sealing implement comprising a plurality of single sealing implements each one of which comprising, a flexible filament part, an insertion head part having an appropriate engaging part provided on one end part of the filament part, and a socket part having a hole for the purpose of irreversibly inserting the insertion head part provided on another end of the filament, wherein a plurality of the single sealing implements are mutually and adjacently arranged in parallel with each other and each of the plurality of insertion head parts or a portion proximity thereto and each of the plurality of socket parts or a portion proximity thereto being caused to be connected to separately provided connecting bars, and wherein at least a part of the filament part of the unit of sealing implement being provided with a curvilinear configured portion or a folded portion, and further wherein at least a part of the filament part of the unit of sealing implement being provided with a filament jamming prevention mechanism whereby a plurality of the filament part adjacently arranged to each other are prevented from jamming each other.

A fifth aspect of the present invention is such that an unit of sealing implement comprising a plurality of single sealing implements each one of which comprising, a flexible filament part, an insertion head part having an appropriate engaging part provided on one end part of the filament part, and a socket part having a hole for the purpose of irreversibly inserting the insertion head part provided on another end of the filament, wherein a plurality of the single sealing implements are mutually and adjacently arranged in parallel with each other and each of the plurality of insertion head parts or a portion proximity thereto and each of the plurality of socket parts or a portion proximity thereto being caused to be connected to separately provided connecting bars, and wherein at least a part of the filament part of the unit of sealing implement being provided with a filament deforming mechanism which can easily deform the filament part into a curvilinear or folded configuration, irreversibly, and further wherein at least a part of the filament part of the unit of sealing implement being provided with a filament jamming prevention mechanism whereby a plurality of the filament part adjacently arranged to each other are prevented from jamming each other.

In order to overcome the above-mentioned drawbacks in the past, the present invention has a basic feature of the present invention in that an unit of sealing implement comprising a plurality of single sealing implements each one of which comprising, a flexible filament part, an insertion head part having an appropriate engaging part provided on one end part of the filament part, and a socket part having a hole for the purpose of irreversibly inserting the insertion head part provided on another end of the filament, wherein a plurality of the single sealing implements are mutually and adjacently arranged in parallel with each other and each of the plurality of insertion head parts or a portion proximity thereto and each of the plurality of socket parts or a portion proximity thereto being caused to be connected to separately provided connecting bars, and further wherein a filament part of the unit of sealing implement showing curvilinear configuration or at least one portion of the filament part thereof provided with a folded portion.

Therefore, in the present invention, the unit of sealing implement as mentioned above can be easily mounted on an attachment shooting gun used for shooting each one of the sealing implements (hereinafter referred to a special shooting gun).

BRIEF DESCRIPTION OF THE DRAWINGS

FIG. 2(A) is a front view of a unit of the inventive sealing implement.

FIGS. 2(B)–2(C) are cross-section views of a filament part.

FIG. 8(A) is a plan view showing a main portion of a filament part of the single sealing implement and FIG. 8(B) shows a cross-section of a main portion of a filament part of the single sealing implement.

FIG. 9(A) is a plan view showing a main portion of a filament part of the single sealing implement and FIG. 9(B) shows a cross-section of a main portion of a filament part of the single sealing implement while FIG. 9(C) and FIG. 9(D) show a cross-section of a main portion of a separate embodiment and a further separate embodiment of a filament part of the single sealing implement, respectively.

FIG. 16(A) is a plan view showing other embodiment in which separate filament jamming prevention mechanism is provided on the sealing implement according to the present invention while FIG. 16(B) and FIG. 16(C) show plan views of a separate embodiment and a further separate embodiment of the sealing implement according to the present invention.

DETAILED DESCRIPTION OF THE PREFERRED EMBODIMENTS

Embodiments of the present invention are described in detail below, with references being made to relevant accompanying drawings.

Figure 1:
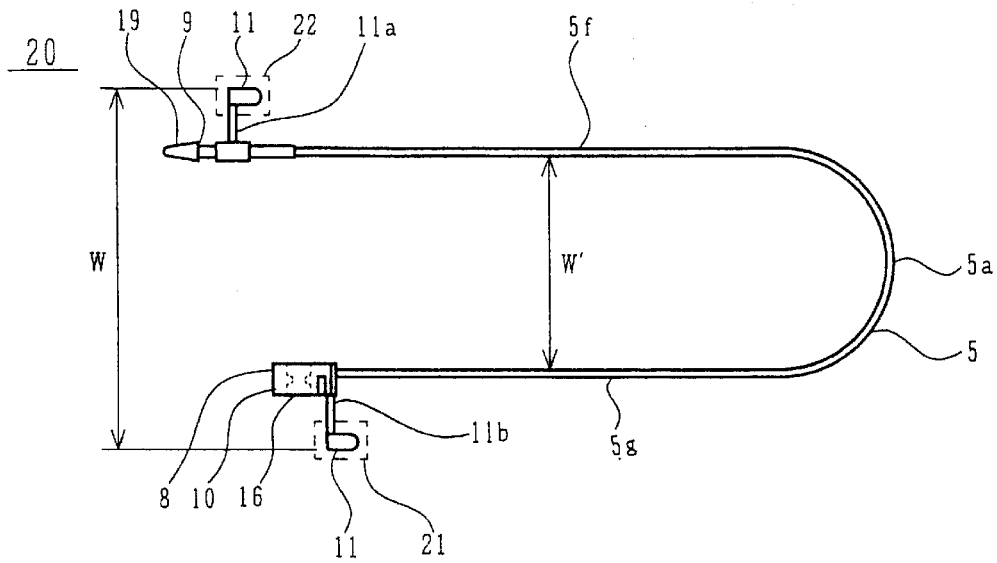
FIG. 1 is an enlarged plan view showing an embodiment of an unit of sealing implement according to the present invention.
Figure 2:
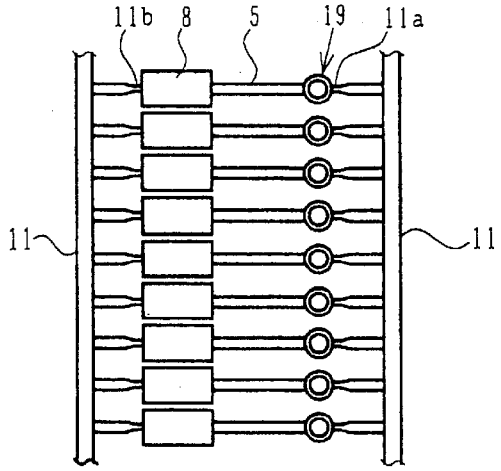
FIG. 2 is an enlarged front view showing an embodiment of an unit of sealing implement according to the present invention.
Figure 2:
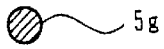
Figure 2:
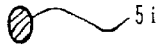
Figure 3:
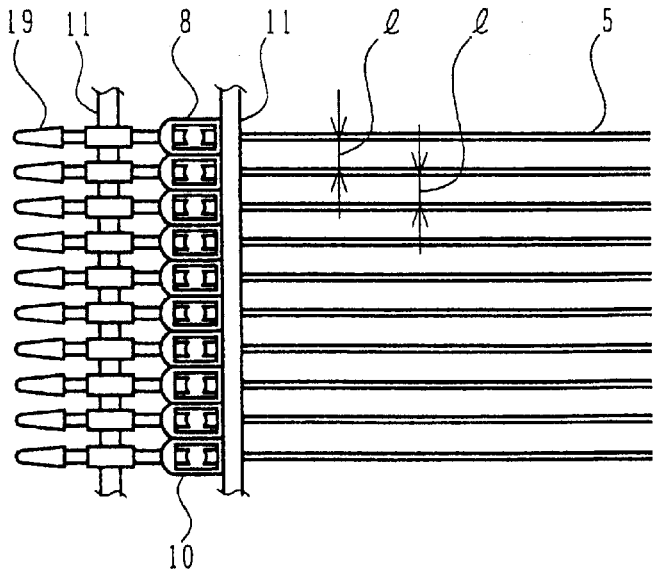
FIG. 3 is an enlarged side view showing an embodiment of an unit of sealing implement according to the present invention.
Figure 4:
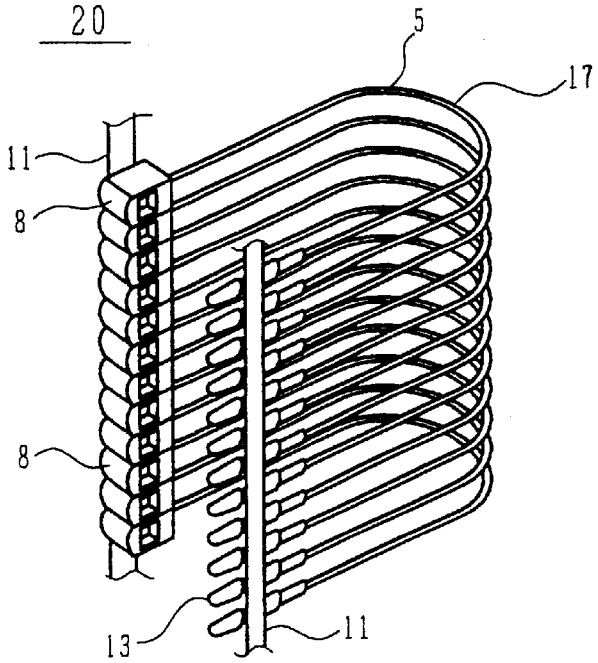
FIG. 4 is a perspective view showing an embodiment of an unit of sealing implement according to the present invention.

Specifically, FIG. 1 is an enlarged plan view showing an embodiment of an unit of sealing implement according to the present invention and FIG. 2, FIG. 3 and FIG. 4 are an enlarged front view, an enlarged side view and a perspective view each showing an embodiment of an unit of sealing implement according to the present invention, respectively.

As shown in these drawings, an unit of sealing implement 20 of the present invention comprises a plurality of single sealing implements each one of which comprising, a flexible filament part 5, an insertion head part 19 having an appropriate engaging part, for example, a blade member 9 provided on one end part of the filament part 5, and a socket part 8 having a hole 10 for the purpose of irreversibly inserting the insertion head part 19 provided on another end of the filament 5, wherein a plurality of the filament parts 5 of the single sealing implements are mutually and adjacently arranged in parallel with each other and each of the plurality of insertion head parts 19 or a portion proximity thereto and each of the plurality of socket parts 8 or a portion proximity thereto being caused to be connected to separately provided connecting bars 11, and further wherein a middle portion 5*a* of the filament part 5 of the unit of sealing implement 20 shows a curvilinear configuration.

In another embodiment of the present invention, if portions of the filament parts 5*f* and 5*g* each of which is extended from the insertion head part 19 and the socket part 8, respectively, are arranged in parallel with each other with a predetermined distance W', interposed therebetween, the middle portion 5*a* of the filament part 5 of the unit of sealing implement 20 may have a folded configuration, instead.

Note that in this case, a portion of the filament parts 5*f* which is connected to the insertion head part 19 and the filament parts 5*g* which is connected to the socket part 8 are arranged substantially in parallel with each other with a predetermined distance W', interposed therebetween.

Further in this embodiment, both of the insertion head part 19 and the socket part 8 are connected to the connecting bars 11 through connecting portions 11*a* and 11*b*, respectively, which can be easily cut off and removed.

The unit of sealing implement 20 according to the present invention is integrally formed of a synthetic resin, such as the usual Nylon, polypropylene, or polyester, such as was the case with sealing implements of the past, with a plurality of the filament parts being arranged into a flat surface configuration.

Then, a center portion of or a portion in a vicinity of a center portion of each one of these filament part 5 is folded so as to make the a portion of the filament parts 5*f* which is extended from the insertion head part 19 and the filament parts 5*g* which is extended from the socket part 8 are arranged substantially in parallel with each other with a predetermined distance W', interposed therebetween.

After that this configuration is irreversibly fixed, for example, by heat set or the like with utilizing a predetermined mold or a predetermined supporting means so as to give at least a portion of the filament part connecting to the insertion head part 19 and the socket part 8, a curvilinear configuration. another embodiment, the unit of sealing implement of the present invention may be previously provided with a curvature or folding portion making support mechanism which make at least a portion of the filament part bendable easily, on at least a portion of the filament part and a heat set operation may be applied to this filament part.

In the present invention, the term "irreversibly bended" means the condition in which after such heat set operation had been applied to the unit of sealing implement, the unit maintains the condition set by such heat set operation, in other word, after the heat set, and when the unit is leave in free condition, the filament part of the unit can keep its curvilinear configuration set by the heat set operation.

Further, in the present invention, the term "W'" denotes a distance with which the unit of sealing implement of the present invention can be mounted on the special gun 18 and the exact distance with which the operation efficiency for the special gun can be improved.

More specifically, a distance W formed between the grooves 21 and 22 for the connecting bars 11, 11 to be inserted thereinto, should preferably be set at a distance which is identical to of substantially the same as a distance W as formed between the connecting bars 11 and 11.

By doing this, the unit of sealing implement of the present invention can be easily mounted on the special gun and can avoid mistakes such as for the unit to be erroneously inserted into the gun with a wrong insertion manner or to be erroneously inserted into the gun in an opposite direction.

Further in the present invention, the width of the special gun 18 can be shortened causing the size of the gun compacted.

The first embodiment of the unit of sealing implement 20 will be further explained with reference to FIG. 1.

First, a basic configuration of the unit of sealing implement 20 is substantially the same as that of the conventional unit of sealing implement.

Note that the socket part 8 has a hole 10 which can pass the insertion head part 19 therethrough, irreversibly.

In the present invention, a cross sectional configuration of the filament part may be any one of configuration selected from a group of circular, flat and rectangular configurations.

In addition, inside the hole 7 of the socket part 8, a mating part 16, which engages with an engaging portion 9 which is a part of the insertion head part 19, is provided.

Such mating part 16 may preferably comprise a projected member or concaved member.

In the unit of sealing implement 20 of the present invention, since a portion around the center portion of the filament part 5 is previously set at the curvilinear configuration or a configuration very closed thereto, irreversibly, it can be easily mounted on the special gun and additionally, the each filament part of the unit of sealing implement 20 is temporarily connected to the connecting bars 11 in parallel with each other.

Accordingly, after the unit of sealing implement had been mounted on the gun, by simply using the operation lever 18*a*, a label is easily attached to a certain good.

FIG. 4 shows a perspective view of the unit of sealing implement of the present invention, in that the unit of sealing implement 20 comprises 40 to 60 ends of filament part which being connected to the connecting bars 11.

The number of ends of the filament part of the present invention can be varied with respect to an object to which this invention to be used.

Figure 5:
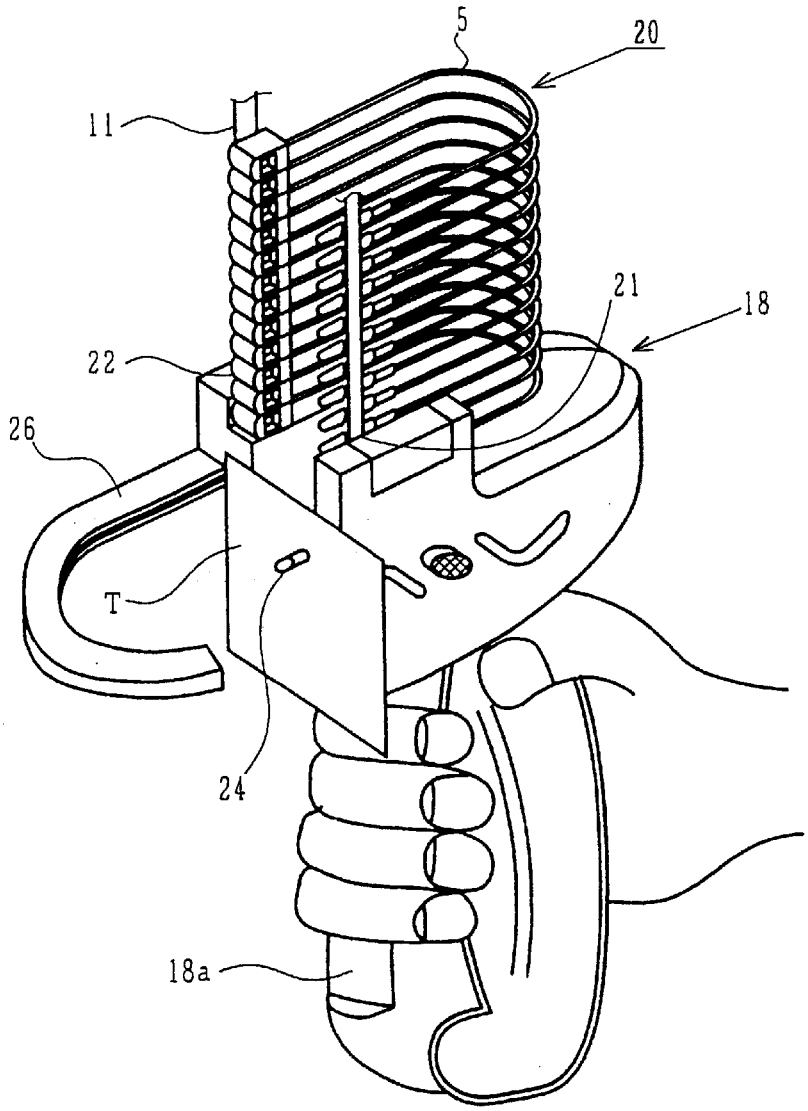
FIG. 5 is a perspective view showing the condition of loading the unit of sealing implements according to the present invention onto a special shooting gun.

As shown above, since the filament part 5 of the unit of sealing implement 20 is previously bended so as to be easily mounted on the special gun 18, an operator can easily mount it on the special gun with only using his one hand as shown in FIG. 5.

Figure 6:
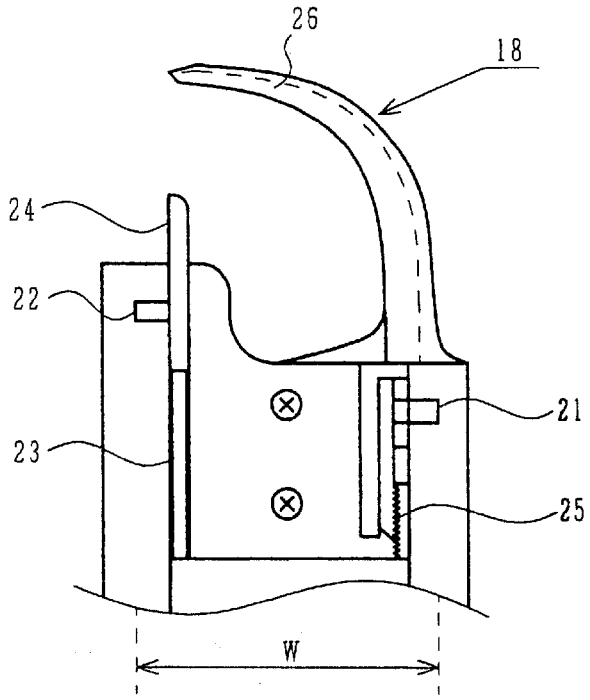
FIG. 6 is a plan view of a main portion of the special gun.

Additionally, FIG. 6 shows a plan view of a main part of the special gun using the unit of sealing implement of the present invention. In In this embodiment, the special gun 18 is provided with a pair of the vertical grooves 21 and 22 on both sides thereof, into which a pair of the connecting bars 11, 11 are inserted, respectively.

For example, the connecting bar 11 which is connected to the socket part 8 of the unit of sealing implement 20 may be inserted into the vertical groove 21 while the connecting bar 11 which is connected to the insertion head part 19 of the unit of sealing implement 20 may be inserted into the vertical groove 22.

On the other hand, the special gun 18 is also provided with a pushing pin mechanism 23 at a position beside the vertical groove 22 and which is driven by actuating the operational lever 18*a* as shown in FIG. 6 so that each one of the insertion head part 19 can be pushed forwardly by the pushing pin mechanism 23 along a hollow guide pin 24, one by one, by removing same from the connecting portion 11a formed on the connecting bar 11.

As the same manner, the socket part 8 guided by the connecting bar 11 which is inserted into the vertical groove 21, is can be pushed by a pushing belt 25 forwardly along a hollow curved socket part guide 26, one by one, by removing same from the connecting portion 11*b* formed on the connecting bar 11 and the socket part 8 pushed out along the socket part guide 26 is changed its forward direction by 90 degree, for example, so as to couple with the insertion head part 19 pushed by the pushing pin mechanism 23 at the hole 10 thereof.

The socket part guide 26 has a hollow tube type passage with a curvature which varies its center axis by 90 degrees so that the pushing belt 25 can easily be moved forwardly through inside thereof and it is so configured that a timing when a tip portion of the pushing belt 25 will reach at a top portion of the socket part guide 26 coincides with a timing when the pushing pin 23 will reach at the top portion of the socket part guide 26.

By doing this, each one of the single sealing implement of the unit of sealing implement 20 can continuously attach a label to a commercial good, sequentially.

In this embodiment, since the filament part of the unit of sealing implement 20 is bended so as to set the distance formed between the connecting bars 11, 11, at a prescribed length, the unit of sealing implement can be easily mounted on the special gun 18 and further there exists a space for inserting label, the operation for attaching label to commercial goods is rendered easily.

In another embodiment of the present invention, at least a portion of the filament part 5, a curvature or folding portion making support mechanism 17 may be provided whereby the mechanism 17 enabling the portion of the filament part 5 to be easily formed into a predetermined configuration, irreversibly.

An example, the curvature or folding portion making support mechanism 17 of this embodiment may comprise a filament part which is made of thermally set table synthetic resin material and further it may comprise a filament part at least one portion of which has a cross sectional area having a flat type configuration including a film like configuration, a rectangular type configuration and an oval type configuration as shown in FIG. 2(C), although a cross sectional configuration thereof is usually circular configuration as shown in FIG. 2(B).

And further, the curvature or folding portion making support mechanism 17 of this embodiment may comprise a filament part which has a groove or a cut portion as well as may comprise a filament part which has a diameter being smaller than that of a main portion of the filament part.

In the above-mentioned embodiment, the filament part having a diameter being smaller than that of a main portion of the filament part includes a tapered portion.

Further, the filament parts 5*g* which is extended from the socket part 8 and the filament parts 5*f* which is extended from the insertion head part 19 show linear configuration, respectively.

In a separate embodiment of the present invention, the filament parts 5*g* which is extended from the socket part 8 and the filament parts 5*f* which is extended from the insertion head part 19 are set in parallel with each other and additionally, a distance W as formed between a pair of the connecting bars 11 and 11, may preferably be set at a distance which is identical to or substantially the same as a distance as formed between the grooves 21 and 22 formed on the special gun 18 using the unit of sealing implement 20 which is mounted thereon.

As mentioned above, at least a portion of the filament part 5, a curvature or folding portion making support mechanism 17 may be provided whereby the mechanism 17 enabling the portion of the filament part 5 to be easily formed into a predetermined configuration, irreversibly and the curvature or folding portion making support mechanism 17 of this embodiment may comprise a filament part which is made of thermally set table synthetic resin material.

And such curvature or folding portion making support mechanism 17 of this embodiment may comprise a filament part which has a cross sectional area having a flat type configuration, a short axis thereof directing to a direction to which the filament part being bent as shown in FIG. 2(C)

And further, the curvature or folding portion making support mechanism 17 of this embodiment may comprise a filament part which has a groove or a cut portion.

A separate example of the curvature or folding portion making support mechanism 17 of this embodiment may comprise a filament part 5 which has a diameter being smaller than that of a main portion of the filament part and such filament part having a diameter being smaller than that of a main portion of the filament part may include a tapered portion.

Further, the filament part 5 having a diameter being smaller than that of a main portion of the filament part may have a cross sectional area which is smaller than that of a main portion of the filament part.

On the other hand, an overall configuration of the unit of sealing implement 20 is formed integrally with synthetic resin and the socket part 8 and the insertion head part 19 are not drawn.

Furthermore, the socket part 8 and the insertion head part 19 may be connected to one of the respective connecting bars 11, through connecting portions being easily removed.

Figure 7:
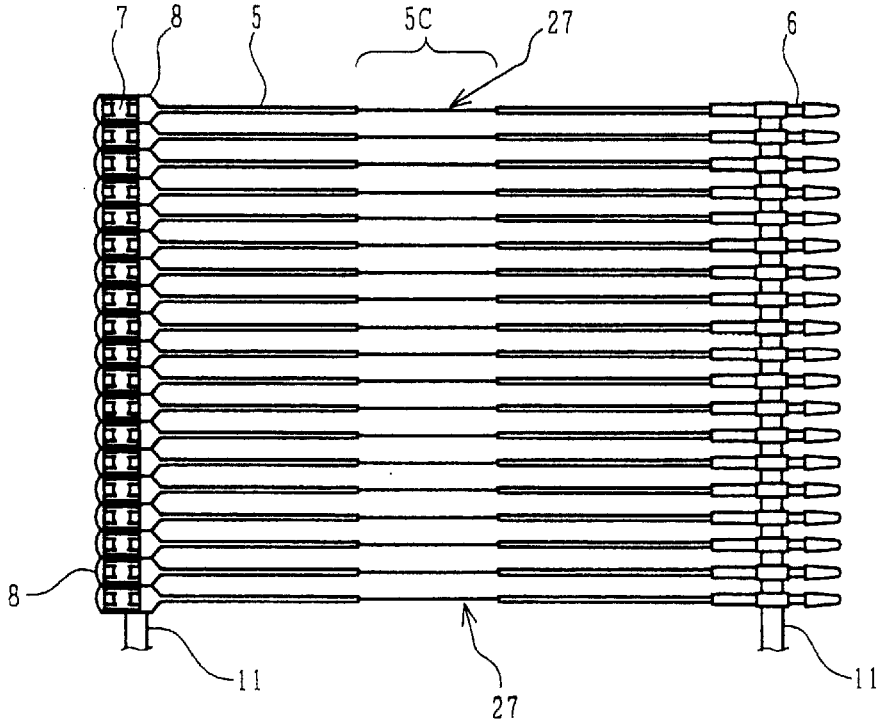
FIG. 7 is a plan view of a second embodiment of an unit of sealing implement according to the present invention.

FIG. 7 shows a front view of the second embodiment of the unit of sealing implement of the present invention.

In that, it is shown the unit of sealing implement 20 comprises a flexible filament part 5, an insertion head part 19 having an appropriate engaging part provided on one end part of the filament part 5, and a socket part. 8 having a hole 10 for the purpose of irreversibly inserting the insertion head part 19 provided on another end of the filament 5, wherein a plurality of the single sealing implements are mutually and adjacently arranged in parallel with each other and each of the plurality of insertion head parts 19 or a portion proximity thereto and each of the plurality of socket parts 8 or a portion proximity thereto being caused to be connected to separately provided connecting bars 11, 11, and further wherein at least a part of the filament part 5 of the unit of sealing implement 20 is provided with a filament deforming mechanism 27 which can easily deform the filament part into a curvilinear or folded configuration, irreversibly.

Figure 8:
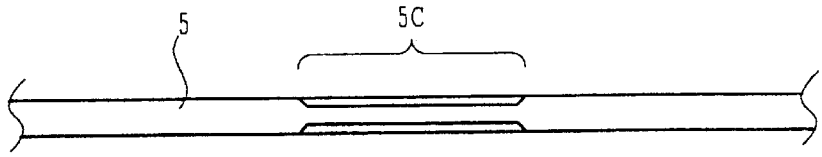
FIG. 8 is a plan view of a single sealing implement used in a third embodiment of an unit of sealing implement according to the present invention.
Figure 8:
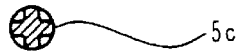

FIG. 8 shows the third embodiment of the present invention in that the filament deforming mechanism 27 is provided at a portion 5*c*, around the center part the filament part 5 with a predetermined width.

This filament deforming mechanism 27 is made of, for example, a heat set table synthetic resin material.

And this filament deforming mechanism 27 may comprise a filament part having a diameter being smaller than that of a main portion of the filament part 5 may have a cross sectional area which is smaller than that of a main portion of the filament part as shown in FIG. 8(A) and FIG. 8(B).

In this embodiment as shown in FIG. 8(B), the cross sectional area thereof shows a cross configuration.

In accordance with this embodiment, the cross sectional configuration is made relatively small so as to make a cross-sectional secondary moment small causing the filament part to be easily bended at this portion.

By taking this configuration, the center portion 5*c* of the filament part becomes easy to be bended and thus a heat set operation becomes simply.

Figure 9:
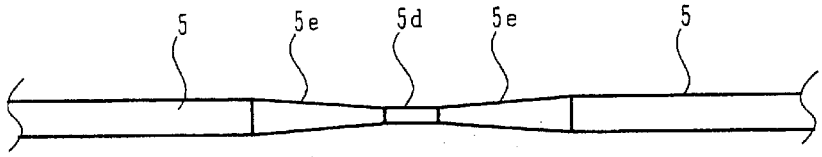
FIG. 9 is a plan view of a single sealing implement used in a fourth embodiment of an unit of sealing implement according to the present invention.
Figure 9:
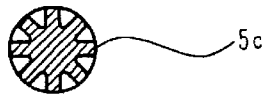
Figure 9:
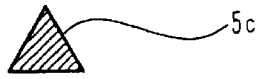
Figure 9:
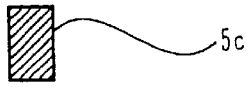

FIG. 9 shows the fourth embodiment of the unit of sealing implement of the present invention, and FIG. 9(A) is a plan view showing a main portion of a filament part of the single sealing implement and FIG. 9(B) shows a cross-section of a main portion of a filament part while FIG. 9(C) and FIG. 9(D) show a cross-section of a main portion of a separate embodiment and a further separate embodiment of a filament part of the single sealing implement, respectively.

In this embodiment, the portion around a center of the filament part 5 has a diameter being smaller than that of a main portion of the filament part 5 and further has a tapered portion 5*e* in which thickness of a normal filament part 5 is gradually reduced to the portion ad thereof having a small diameter.

The filament deforming mechanism 27 of this embodiment may comprise a filament part 5 made of heat set table synthetic resin and further may comprise a filament part 5 which has a flat type cross sectional configuration or an oval type configuration which having a long axis thereof being perpendicular to a bending direction of the filament part 5.

And further, filament deforming mechanism 27 of this embodiment may comprise a filament part 5 at least one portion of which having a groove or cut portion as well as it 20 may be formed integrally with synthetic resin.

Furthermore, the socket part 8 and the insertion head part 19 may be connected to one of the respective connecting bars 11, through connecting portions being easily removed.

In other examples of the filament deforming mechanism 27 of this embodiment, the filament deforming mechanism 27 may comprise a filament part 5*d* which has a diameter being smaller than that of a main portion of the filament part 5 and such filament part 5*d* having a diameter being smaller than that of a main portion of the filament part may include a tapered portion 5*e*.

Further, the filament part 5*d* having a diameter being smaller than that of a main portion of the filament part 5 may have a cross sectional area which is smaller than that of a main portion of the filament part 5.

The cross sectional configurations of the filament part 5*d* having a diameter being smaller than that of a main portion of the filament part 5 may be any one of the configurations selected from the group of a star type configuration, a triangle type configuration and a rectangular configuration as shown in FIGS. 9(B), (C) and (D), respectively.

In accordance with this embodiment, a cross-sectional secondary moment of the filament part 5*d* having a diameter being smaller than that of a main portion of the filament part 5 and the tapered portion 5*e* become relatively small so as to reduce the filament part to be easily bended and heat set.

Figure 10:
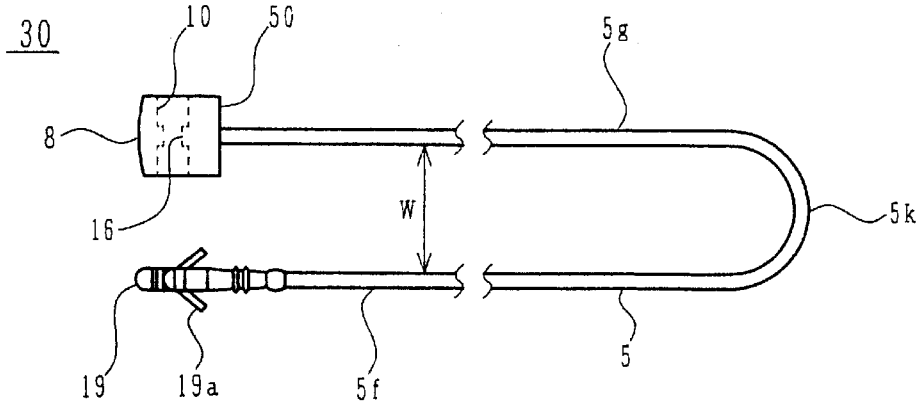
FIG. 10 is a plan view of a fifth embodiment of an unit of sealing implement according to the present invention.

FIG. 10 shows a plan view of the fifth embodiment of the present invention.

Note that the fifth embodiment of the present invention relates to a single sealing implement which comprises a filament part 5, an insertion head part 19 having an appropriate engaging part 19*a* provided on one end part of the filament part 5, and a socket part 8 having a hole 10 for the purpose of irreversibly inserting the insertion head part 19 provided on another end of the filament 5, wherein at least a part of the filament part 5 is provided with a bended portion 5*k* at which the part of the filament part 5 is irreversibly curved or bended into a predetermined configuration, and further wherein, both of the filament part 5*f* connected to the socket part 8 and the filament part 5*g*connected to the insertion head part 19 substantially show a linear configuration, respectively.

In this embodiment, one of sealing implement 30 which are component of the unit of sealing implement 20 can be separately formed and this single sealing implement 30 may be used for attaching tag to a commercial good by manual operation, for example.

The single sealing implement 30 comprises filament part 5, an insertion head part 19 having an appropriate engaging part provided on one end part of the filament part 5, and a socket part 8 having a hole 10 for the purpose of irreversibly inserting the insertion head part 19 provided on another end of the filament 5, wherein at least a part of the filament part 5 is provided with a bended portion 5*k* at which the part of the filament part 5 is irreversibly curved or bended into a predetermined configuration, and further wherein, both of the filament part 5*f* connected to the socket part 8 and the filament part 5*g* connected to the insertion head part 19 substantially show a linear configuration, respectively.

One example of the bended portion 5k may comprise a portion of the filament part 5 which has a cross section having a flat type configuration or a oval type configuration.

And further, the bended portion 5*k* may comprise a filament part 5 at least one portion of which having a groove or cut portion as well as it 5*k* may comprise a filament part ad which has a diameter being smaller than that of a main portion of the filament part 5 and such filament part 5*d* having a diameter being smaller than that of a main portion of the filament part.

Furthermore, the bended portion 5*k* may comprise a filament part 5 which includes a tapered portion.

Moreover, another example of this embodiment, the single sealing implement 30 is provided with a finger contact grasping portion 50 to which a tip portion of a finger of an operator is contacted, and which has a substantial rectangular configuration in a direction from the socket part 8 to the filament part 5 and when the single sealing implement 30 is picked up by a finger of an operator, a tip portion of a finger of the operator is preferentially contacted to the finger contact grasping portion 50.

Accordingly, the socket part 8 is necessarily fixed on an upper position of a tip portion of the operator's finger.

Figure 11:
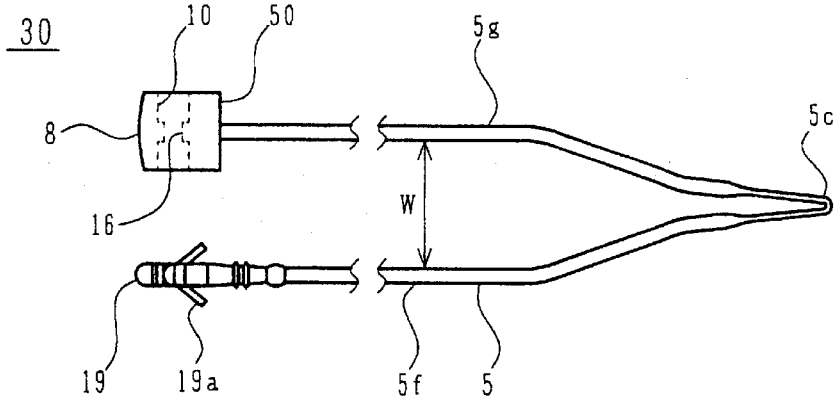
FIG. 11 is a plan view of a sixth embodiment of an unit of sealing implement according to the present invention.

FIG. 11 shows a plan view of the sixth embodiment of the present invention.

In this embodiment, both of the filament part 5*g* extending from the socket part 8 and the filament part 5*f* extended from the insertion head part 19 substantially are formed and arranged in substantially parallel with each other with a predetermined distance W' interposed therebetween and the center portion 5*c* of the filament part 5 is folded with an acute angle.

By taking this configuration, an operation for attaching a label to a commercial good becomes easy and further since the label as attached to the commercial good is fixedly kept at this bended portion, the label is difficult to be moved resulting the label to be read characters presented on the label easily.

Figure 12:
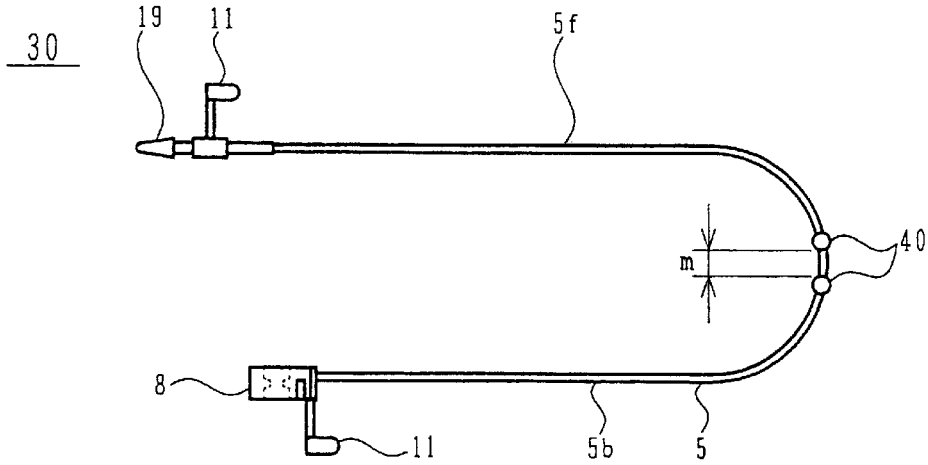
FIG. 12 is a plan view of another embodiment of an unit of sealing implement according to the present invention, in which a filament jamming prevention mechanism is provided on a curved portion of a filament part of the sealing implement.
Figure 13:
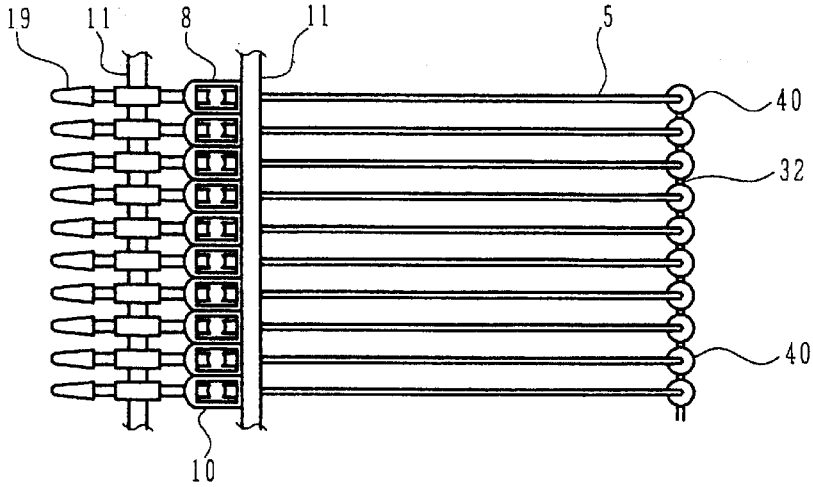
FIG. 13 is a side view of the embodiment as shown in FIG. 12.

FIG. 12 shows a plan view of an embodiment of a single sealing implement 30 in which a filament jamming prevention mechanism is provided on a curvilineare portion of a filament part and FIG. 13 shows a side view of an unit of sealing implement comprising a plurality of the single sealing implement as mentioned above.

In this embodiment, an unit of sealing implement comprising a plurality of single sealing implements each one of which comprising, a filament part 5, an insertion head part 19 having an appropriate engaging part provided on one end part of the filament part 5, and a socket part 8 having a hole 10 for the purpose of irreversibly inserting the insertion head part 19 provided on another end of the filament 5, wherein a plurality of the single sealing implements are mutually and adjacently arranged so that each of the filament part 5 being arranged in parallel with each other and each of the plurality of insertion head parts 19 or a portion proximity thereto and each of the plurality of socket parts 8 or a portion proximity thereto being caused to be connected to separately provided connecting bars 11, and wherein at least a part of the filament part 5 of the unit of sealing implement being provided with a curvilinear configured portion or a folded portion, and further wherein at least a part of the filament part 5 of the unit of sealing implement being provided with a filament jamming prevention mechanism 40 whereby a plurality of the filament part 5 adjacently arranged to each other are prevented from jamming each other.

In this embodiment, two spherical portions 40 separated from each other with a predetermined distance m, are provided at a center portion of the curvilineare portion of the filament part 5.

Each of the spherical portions 40 formed on each one of the filament parts 5 adjacently arranged to each other when they are associated into the unit of sealing implement, are connected to each other in a vertical direction utilizing a connection portion 32.

By taking this configuration, jamming condition or intermingled condition would occur among the filament parts specifically at a portion of the curvilineare portion of the filament part, will surely be prevented.

And when a label is placed at a place between two spherical portions 40, the label is never moved therefrom so that the label is made to be easily observed.

Figure 14:
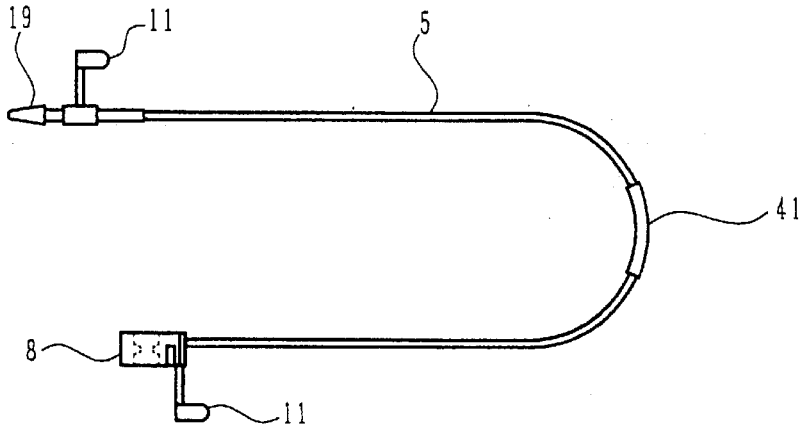
FIG. 14 is a plan view showing a separate embodiment in which another type of filament jamming prevention mechanism is provided on the sealing implement according to the present invention.
Figure 15:
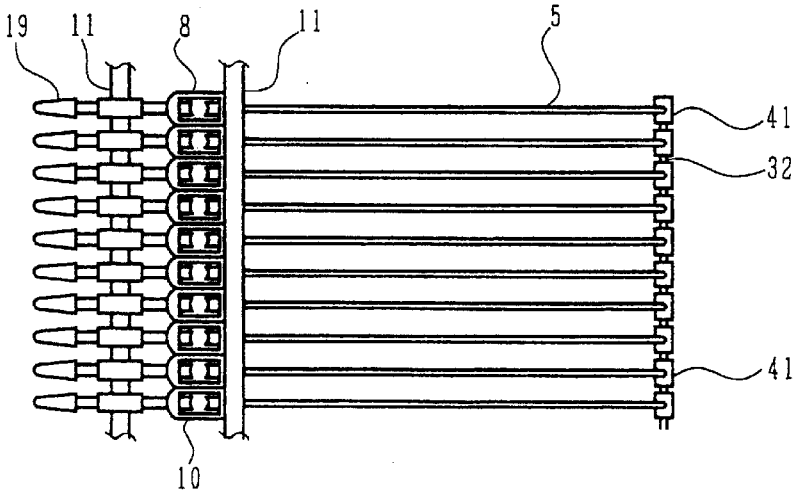
FIG. 15 is a side view of the embodiment as shown in FIG. 14.

FIG. 14 shows a plan view of another embodiment of an unit of sealing implement in which a filament jamming prevention mechanism is provided on a curvilineare portion of each one of a filament part and FIG. 15 shows a side view of the unit of sealing implement as shown in FIG. 14.

In this embodiment, at a portion approximately to a center portion of the filament part, a portion of the filament part which has an extended portion 41 having a cross section of a rectangular configuration is provided along a predetermined length.

A maximum diameter of the extended portion 41 is preferably smaller than a hole provided on the label, for example, 1.9 to 2.0 mm.

On the other hand, a plurality of the extended portion 41 each adjacently arranged to each other for example in a vertical direction, may be connected with each other via a connection portion 32.

By taking this configuration, jamming condition or intermingled condition would occur among the filament parts specifically at a portion of the curvilineare portion of the filament part, will surely be prevented.

And when a label is placed at a place on the extended portion 41, the label is never moved therefrom so that the label is made to be easily observed.

Figure 16:
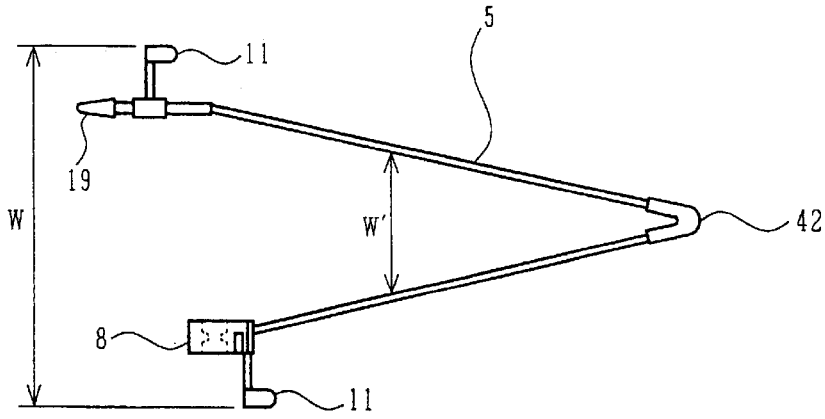
Figure 16:
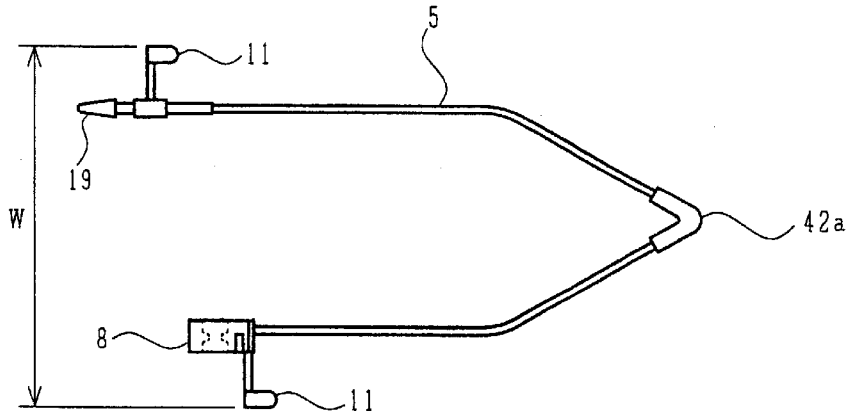
Figure 16:
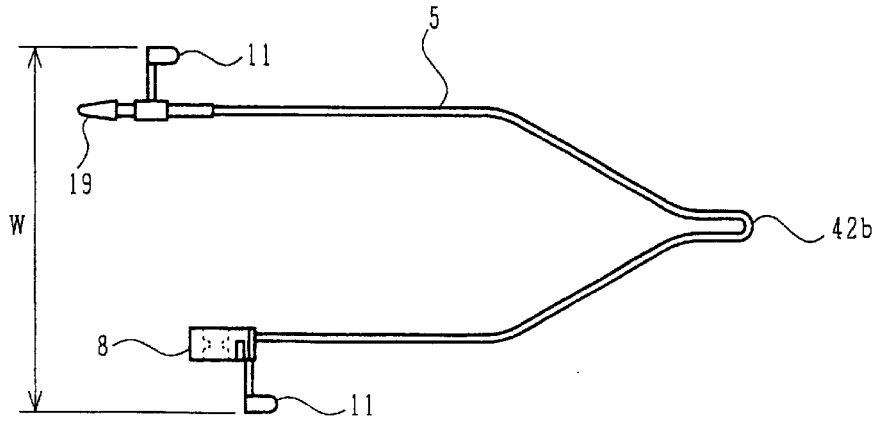
Figure 17:
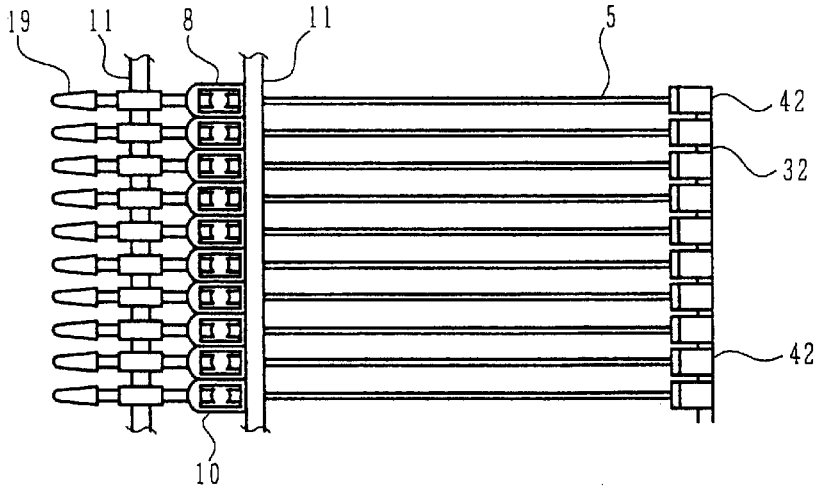
FIG. 17 is a side view of the embodiment as shown in FIG. 16.

FIG. 16(A) shows a plan view of a separate embodiment of an unit of sealing implement in which a filament jamming prevention mechanism is provided on a filament part of the present invention and FIG. 17 shows a side view of the unit of sealing implement as shown in FIG. 16(A).

In this embodiment, at a portion approximately to a center portion of the filament part 5, the portion thereof is bent with a V shaped configuration and the V shaped vent portion is provided with an extended portion 42.

In this embodiment, each one of the extended portions 42 adjacently arranged vertically are connected to each other with a connecting member 32.

By doing this, jamming condition or intermingled condition would occur among the filament parts specifically at a portion of the V shaped vent portion thereof, will surely be prevented.

And when a label is placed at a place on the extended portion 41, the label is never moved therefrom so that the label is made to be easily observed.

Further, the insertion head parts 19 and the socket parts 8 insertion head parts single sealing implements 5 may be arranged in parallel with each other with respect to the V shaped filament part 5.

FIG. 16(B) shows a plan view of an another embodiment of an unit of sealing implement in which both end portions of a filament part 5 are arranged in parallel with each other for a prescribed length thereof and a center portion or around the center portion of the filament part is vent-with a V charactered configuration and at the same place, a V shaped vent portion is provided with an extended portion 42*a*.

FIG. 16(C) shows a plan view of a further separate embodiment of an unit of sealing implement of the present invention, in which both end portions of a filament part 5 are arranged in parallel with each other for a prescribed length thereof and a center portion or around the center portion of the filament part is vent with a V charactered configuration and at the same place, a U shaped extended portion 42*b* is provided.

By doing this, jamming condition or intermingled condition would occur among the filament parts specifically at a portion of the V shaped vent portion thereof, will surely be prevented.

And when a label is placed at a place on the extended portion 42*a* or 42*b*, the label is never moved therefrom so that the label is made to be easily observed.

Figure 18:
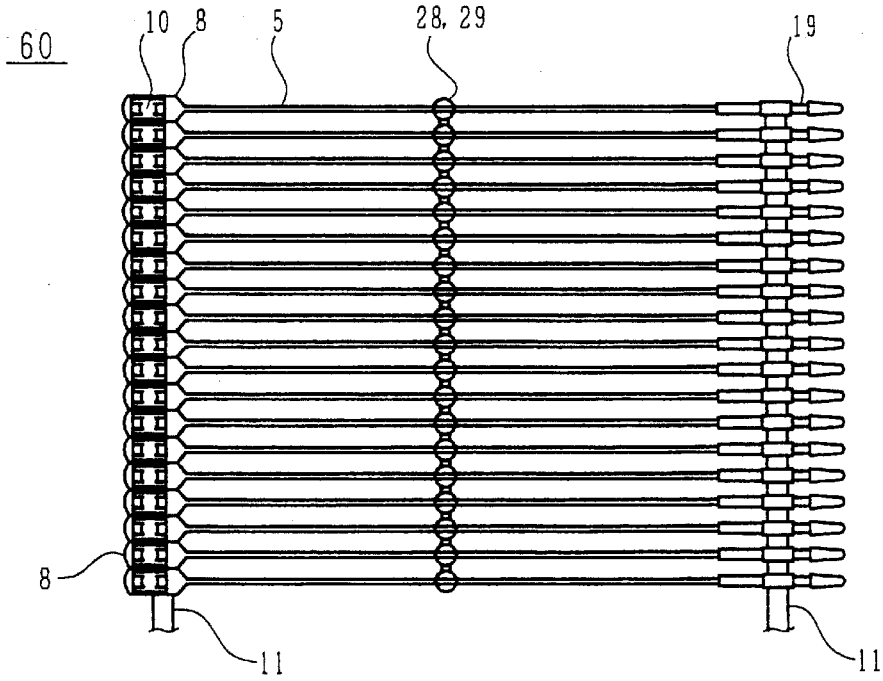
FIG. 18 is a plan view of a seventh embodiment of an unit of sealing implement according to the present invention.

FIG. 18 shows a front view of a seventh embodiment of an unit of sealing implement of the present invention.

In this embodiment, in is shown that an unit 60 of sealing implement comprising a plurality of single sealing implements each one of which comprising, a flexible filament part 5, an insertion head part 19 having an appropriate engaging part provided on one end part of the filament part 5, and a socket part 8 having a hole 10 for the purpose of irreversibly inserting the insertion head part l9 provided on another end of the filament, wherein a plurality of the single sealing implements are mutually and adjacently arranged in parallel with each other and each of the plurality of insertion head parts 19 or a portion proximity thereto and each of the plurality of socket parts 8 or a portion proximity thereto being caused to be connected to separately provided connecting bars 11, and further wherein at least a part of the filament part 5 of the unit of sealing implement being provided with a filament deforming mechanism 28 which can easily deform the filament part into a curvilinear or folded configuration, irreversibly, and further wherein at least a part of the filament part 5 of the unit of sealing implement being provided with a filament jamming prevention mechanism 29 whereby a plurality of the filament part adjacently arranged to each other are prevented from jamming each other.

In the embodiment, on at least a part of the filament part 5, a filament jamming prevention mechanism 29, whereby a plurality of the filament parts 5 adjacently arranged to each other are prevented from jamming each other.

And further, these spherical portion 29 contributes to prevent a plurality of the filament parts arranged in parallel to each other from being intermingeled with each other when the filament parts 5 is vent.

Figure 19:
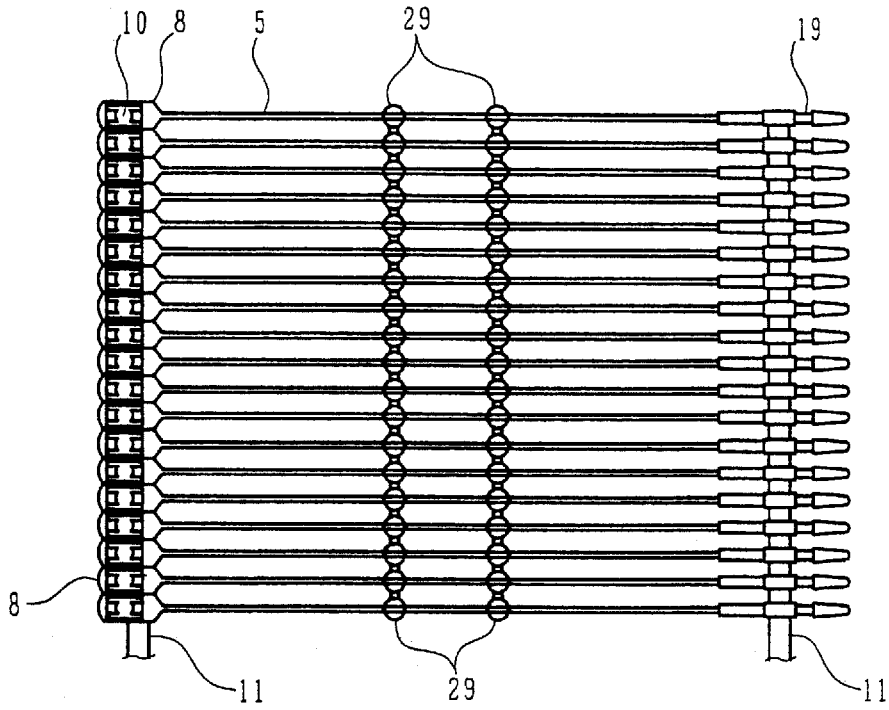
FIG. 19 is a plan view of a eighth embodiment of an unit of sealing implement according to the present invention.

FIG. 19 shows a front view of an eighth embodiment of an unit of sealing implement of the present invention.

In this embodiment, two spherical portions 29 having a diameter being larger than a diameter of the filament part 5, and which serve as the filament jamming prevention mechanism 29, which can prevent a plurality of the filament parts 5 adjacently arranged to each other from being jammed or intermingeled with each other, are provided on the filament part therealong with a prescribed distance interposed therebetween.

By providing a plurality of the filament jamming prevention mechanism 29 along the filament part, the effect of preventing a plurality of the filament parts 5 adjacently arranged to each other from being jammed or intermingeled with each other, can be improved.

Figure 20:
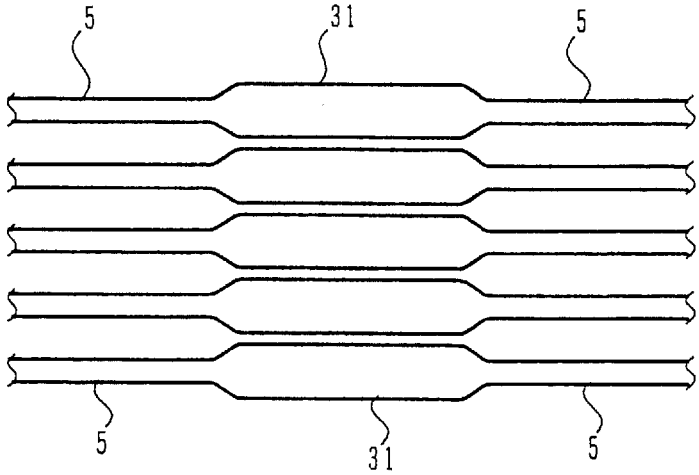
FIG. 20 is an enlarged plan view of a main portion of a ninth embodiment of an unit of sealing implement according to the present invention.
Figure 21:
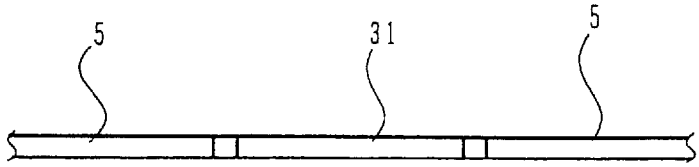
FIG. 21 is an enlarged plan view of a main portion of ninth embodiment of an unit of sealing implement according to the present invention.

FIG. 20 shows an enlarged front view of a main portion of a ninth embodiment of an unit of sealing implement of the present invention and FIGS. 21 shows an enlarged front view of a main portion of a tenth embodiment of an unit of sealing implement of the present invention.

In these embodiments, at a center portion or at a portion in a vicinity of the center portion of the filament part 5, a plate like enlarged portion 31 having a polygonal configuration is provided as the filament jamming prevention mechanism 29.

This plate like enlarged portion 31 has a width as same as a width of the filament part 5 and a heigh a value of which is set so that each one of the plate like enlarged portions 31 each adjacently being arranged to each other without contacting with each other in a vertical direction.

By taking this configuration, the filament parts 5 is prevented from being intermingeled with each other when the filament parts 5 is vent.

Figure 22:
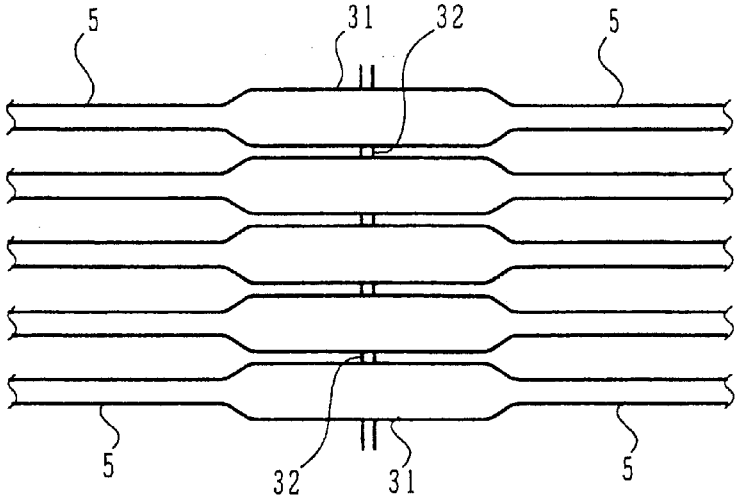
FIG. 22 is an enlarged plan view of a main portion a tenth embodiment of an unit of sealing implement according to the present invention.

FIG. 22 shows an enlarged front view of a main portion of a eleventh embodiment of an unit of sealing implement of the present invention.

In this embodiment, each one of the plate like enlarged portions 31 each adjacantly being arranged to each other in a vertical direction, are connected with each other with a connecting member 32.

The connecting member 32 has a strength whereby the connecting member 32 is easily cut off when the unit of single sealing implements is mounted on the shooting gun 18 thereof.

In this embodiment, the connecting member 32 is provided at a center or in a vicinity of the center of the plate like enlarged portion 31.

Figure 23:
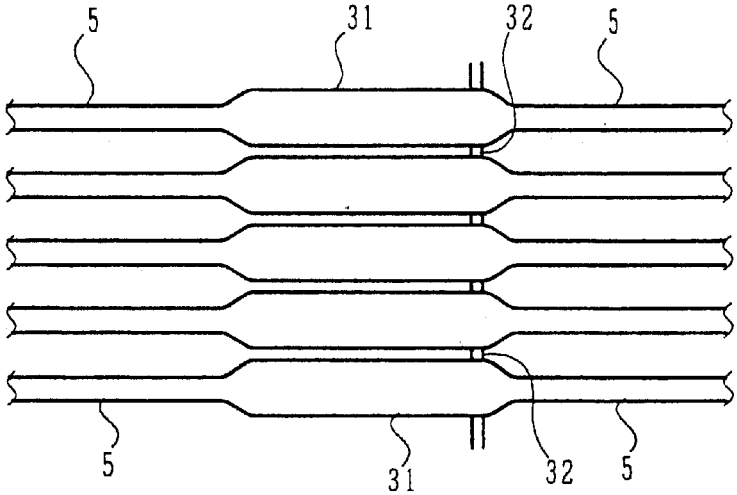
FIG. 23(A) is an enlarged plan view of one aspect of an eleventh embodiment of an unit of sealing implement and FIG. 23(B) is other aspect of an eleventh embodiment of an unit of sealing implement according to the present invention.
Figure 23:
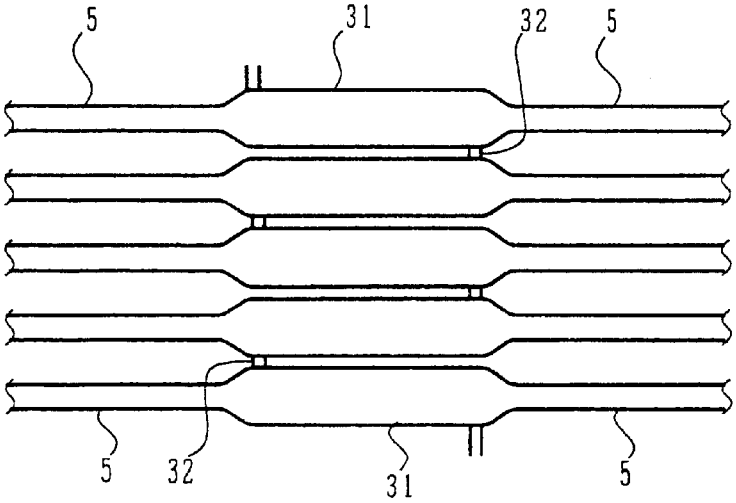

Note that in the further separate embodiment as shown in FIG. 23(A), the connecting member 32 can be provided at an end portion of the plate like enlarged portion 31 as well as the connecting members 32 can be provided at both ends portion of the plate like enlarged portion 31 in a zig-zag manner.

In this embodiment, when the plate like enlarged portions 31 are connected to each other via the connecting members 32, the jamming or intermingling of the filament part 5 can be more effectively prevented.

Further, when the plate like enlarged portions 31 are connected to each other via the connecting members 32, which are provided on an end portion of each of the plate like enlarged portions 31, a cutting operation can be effectively implemented when the unit of single sealing implements is mounted on the shooting gun 18.

Figure 24:
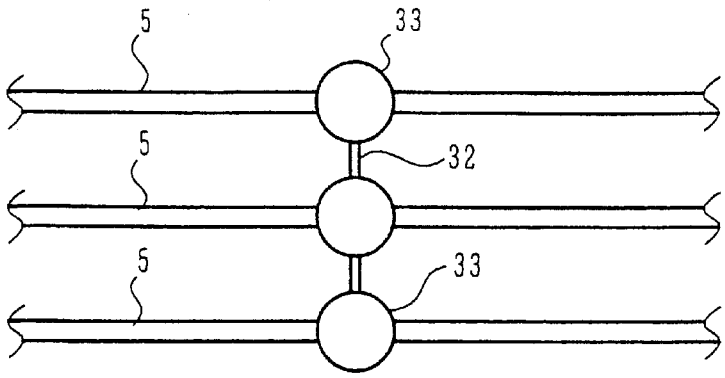
FIG. 24 is an enlarged plan view of a twelfth embodiment of an unit of sealing implement according to the present invention.
Figure 25:
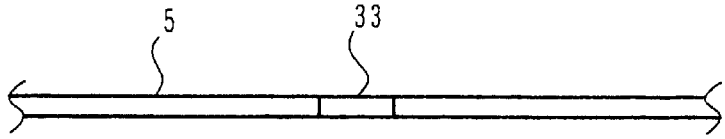
FIG. 25 is an enlarged side view of a twelfth embodiment of an unit of sealing implement according to the present invention.

FIG. 24 shows an enlarged front view of a main portion of a twelfth embodiment of an unit of sealing implement of the present invention and FIG. 25 shows an enlarged plan view of a main portion of the twelfth embodiment.

In this embodiment, a filament jamming prevention mechanism 29 comprises a circular plate 33 which is provided on at a center or in the vicinity of the center of the filament part 5.

This circular plate 33 has a diameter which is larger than that of the filament part 5 and a value of which is set so that each one of the circular plate 33 each adjacently being arranged to each other without contacting with each other in a vertical direction.

Further in this embodiment, each one of the circular plate 33 are connected with each other with an connecting member 32.

By taking this configuration, the filament parts 5 arr prevented from being intermingled with each other when the filament parts 5 is vent and mounted on the shooting gun 18.

FIG. 26(A) shows an enlarged plan view of a main portion of a thirteenth embodiment of an unit of sealing implement of the present invention.

In this embodiment, the filament jamming prevention mechanism 29 comprises an oval shaped plate 34 and two of these oval shaped plates 34 are provided on and arranged along the filament part 5 with a prescribed distance interposed therebetween.

By doing this, jamming condition or intermingled condition would occur among the filament parts 5 can be surely prevented. 26(B) shows an enlarged front view of a main portion of further separate embodiment of an unit of sealing implement of the present invention.

In this embodiment, the filament jamming prevention mechanism 29 comprises a triangular or a corn shape type member 35 and two of these shaped plates 35 are provided on and arranged along the filament part 5 with a prescribed distance interoosed therebetween.

By doing this, jamming condition or intermingled condition would occur among the filament parts 5 can be surely prevented in addition to this, if when a label can be placed at a portion formed between both triangular or a corn shape type members 35, the label is never moved therefrom so that the label is made to be easily observed.

In another embodiment of the present invention the filament jamming prevention mechanism may comprise a member having a pyramid type configuration and further it may comprise a film like member a flat surface of which faces to a direction which is perpendicular to a direction along which the filament parts are arranged.

And further, at least two filament jamming prevention mechanisms 29 may be adjacently formed on the filament part or may be formed thereon with a predetermined distance.

Moreover, the filament jamming prevention mechanism 29 may be formed on each one of the filament parts 5, respectively, in a zig-zag configuration instead of forming the mechanism on the same portion of each filament part, respectively.

Further, it may be provided on filament parts which are selected from every second filament part in an arrangement thereof for the unit of single sealing implement.

Figure 26:
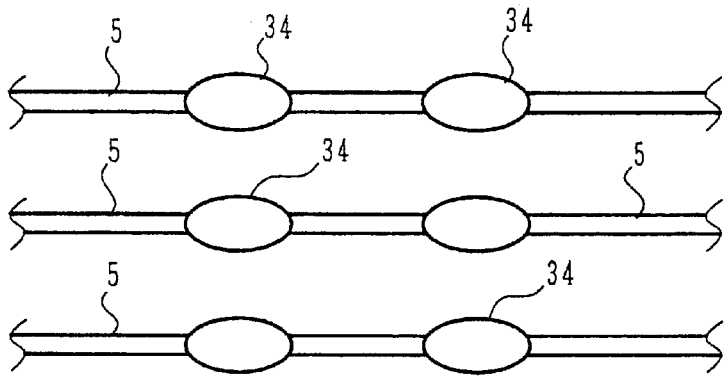
FIG. 26(A) is an enlarged plan view of one aspect of a thirteenth embodiment of an unit of sealing implement and FIG. 26(B) is other aspect of a thirteenth embodiment of an unit of sealing implement according to the present invention.
Figure 26:
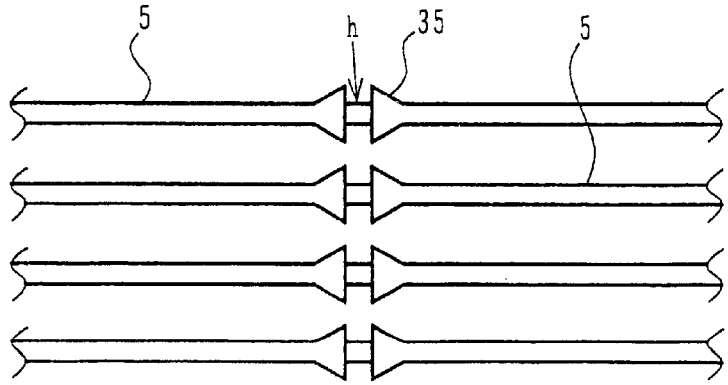
Figure 27:
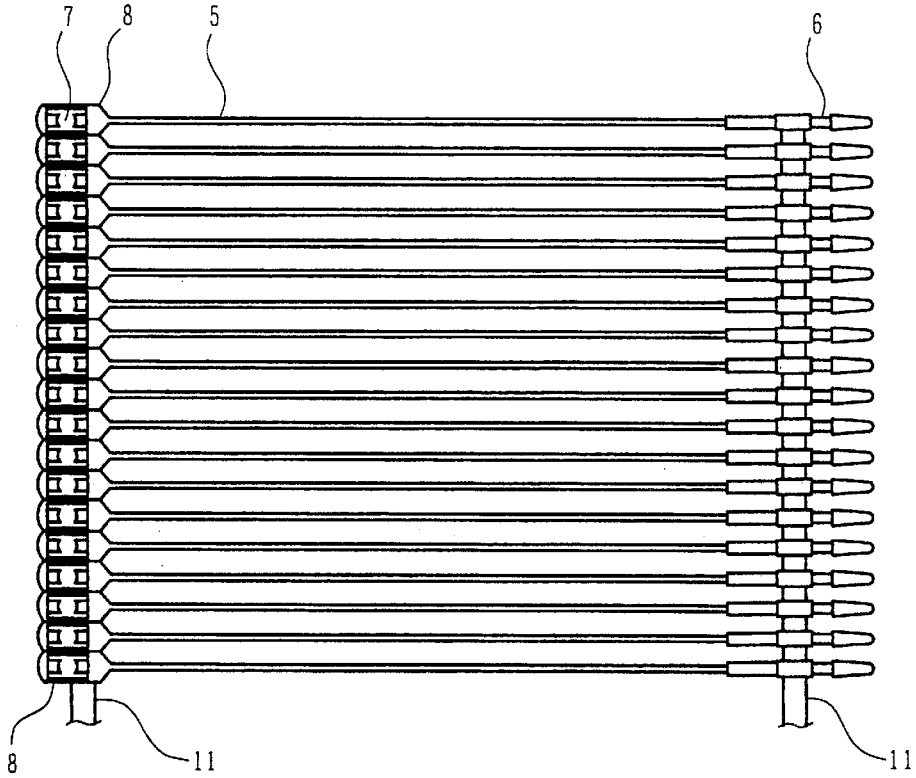
Fig. 27 4 PRIOR ART
FIG. 27 is a front view of a conventional unit of sealing implement.

And when two filament jamming prevention mechanisms are provided in a manner as shown in FIGS. 19 or 26, a filament deforming mechanism as mentioned above can be provided between them so that the filament part is made to be easily deformed or easily be cut. Further when each of the filament jamming prevention mechanisms are connected with each other with a connecting member 32 as shown in FIGS. 13, 15, 17, 22, and 24, the connecting member 32 may be so configured that it can be easily cut off by any one of twisting force, stretching force or shearing force.

Note that, the filament part of the unit of single sealing implements of the present invention, may have a circular cross-section or may have a cross-section selected from a flat type configuration, a oval type configuration and a rectangular configuration.

Further, a size of the socket parts is preferably set at a size with which enabling the handling thereof easily and being externally small.

Since the present invention introduces the above-mentioned configuration, a various kinds of remarkable effects can be obtained.

One remarkable effect of the present invention is such that it is not required that a flat type unit of single sealing implements should be bent so as to mate with the shooting gun which is specifically designed for shooting each one of the filament part by one by so as to make sealing continuously by actuating an operating lever, when the unit of single sealing implements is to be mounted on the shooting gun, since the unit of single sealing implements had been previously bent, and such mounting operation for the unit of single sealing implements is very easy.

In addition to this, since the unit of single sealing implements had been previously bent, a size of the shooting gun can be minimize as well as the occurrence of the jamming or intermingling of the filament part can be remarkably reduced.

Further, in the conventional flat type unit of single sealing implements, since an operator must mount the unit of a shooting gun by manually bending the unite causing this operation to be complicate and inconvenience.

However, in the present invention, the unit of single sealing implements can be easily mounted on the gun as it is.

And further in the past, there were many cases in that an operator erroneously mount the unit of single sealing implements on the gun by bending same in an opposite direction.

However, in the present invention, since the unit of single sealing implements of the present invention is already bent in a correct direction so that the insertion head part and the socket parts are directing to the correct direction and accordingly, the operator never make a mistake in mounting the unit of single sealing implements on the gun.

Further, in the present invention, since a filament deforming mechanism is provided, the unit of single sealing implements can be easily mounted on the shooting gun by bending each one of the filament part having strait linear configuration, easily or if the single sealing implement is used individually for sealing, it is easily attach a label to a commercial good.

And further, in the present invention, since the filament deforming mechanism is provided, a processing operation in that such a curvilinear bent portion or folded portion should be formed, becomes easy.

On the other hand, since the filament jamming prevention mechanism is provided in the present invention, such an intermingle of the filament parts will be prevented and thus when the unit of single sealing implements is mounted on the gun, the operation thereof can be implemented smoothly so that an occurrence of the jamming condition can previously be prevented.

And further when the filament jamming prevention mechanism comprises a film like member, an aperture of a label can be folded at this film like member so that the label is never moved causing no problem in that a displayed characters on the label cannot be easily observed.

Further, in the present invention, when a part of the filament part is made to be easily cut off, in a case when a third party has intentionally broken the seal of the single sealing implement, an evidence can be remained by which the fact or the condition thereof can be easily acknowledged.

What is claimed is:

1. An unit of sealing implement comprising a plurality of single sealing implements each one of which comprising:

a flexible filament part;

an insertion head part having an appropriate engaging part provided on one end part of said filament part; and a socket part having a hole for the purpose of irreversibly inserting said insertion head part provided on another end of said filament, wherein, a plurality of said single sealing implements are mutually and adjacently arranged in parallel with each other, each of said plurality of insertion head parts or a portion proximity thereto and each of said plurality of socket parts or a portion proximity thereto are connected to separately provided connecting bars, and a filament part of each said unit of sealing implement shows a curvilinear portion.

2. An unit of sealing implement according to claim 1, wherein both of said filament part connected to said socket part and said filament part connected to said insertion head part show linear configuration, respectively.

3. An unit of sealing implement according to claim 1, wherein both of said filament part connected to said socket part and said filament part connected to said insertion head part are arranged in parallel with each other.

4. An unit of sealing implement according to claim 1 in further combination with an attachment gun, wherein a distance formed between said pair of connecting bars is set at a length identical to a distance formed between a pair of connecting bars insertion grooves provided on the attachment gun which is used with mounting said unit of sealing implement.

5. An unit of sealing implement according to claim 1, wherein the curvilinear portion of each said filament part is irreversibly formed.

6. An unit of sealing implement according to claim 5, wherein said curvilinear portion is made of thermally settable synthetic resin material.

7. An unit of sealing implement according to claim 5, wherein said curvilinear portion has a cross sectional area having an oval configuration.

8. An unit of sealing implement according to claim 1, wherein said curvilinear portion has a cross sectional area having an oval configuration.

9. An unit of sealing implement according to claim 5, wherein said curvilinear portion has a circular cross-section.

10. An unit of sealing implement according to claim 1, wherein said curvilinear portion has an oval cross-section.

11. An unit of sealing implement according to claim 1, wherein said filament part having said curvilinear portion has a diameter smaller than a diameter of any cylindrical portion of said insertion head part.

12. An unit of sealing implement according to claim 1, wherein said curvilinear portion has a diameter equal to that of a remaining portion of said filament part.

13. An unit of sealing implement according to claim 1, wherein overall configuration of each one of said sealing implements, respectively, is formed integrally with synthetic resin.

14. An unit of sealing implement comprising a plurality of single sealing implements each one of which comprising:

a flexible filament part;

an insertion head part having an appropriate engaging part provided on one end part of said filament part; and a socket part having a hole for the purpose of irreversibly inserting said insertion head part provided on another end of said filament, wherein, a plurality of said single sealing implements are mutually and adjacently arranged, planarly parallel with each other, each of said plurality of insertion head parts or a portion proximity thereto and each of said plurality of socket parts or a portion proximity thereto being connected to separately provided connecting bars, and at least a part of said filament part of each said unit of sealing implement being provided with an irreversibly formed curvilinear portion.

15. An unit of sealing implement according to claim 14, wherein said curvilinear portion is made of thermally settable synthetic resin material.

16. An unit of sealing implement according to claim 14, wherein said filament part has a cross sectional area having a circular cross-section.

17. An unit of sealing implement according to claim 15, wherein said filament part has a circular cross-section portion.

18. An unit of sealing implement according to claim 14, wherein overall configuration of each one of said sealing implements, respectively, is formed integrally with synthetic resin.

19. An unit of sealing implement according to claim 14, wherein said curvilinear portion as a diameter smaller than that of a main portion of said filament part.

20. An unit of sealing implement according to claim 14, wherein said curvilinear portion has a diameter smaller than that of a main portion of said insertion head part.

21. An unit of sealing implement according to claim 19, wherein said filament part having a diameter being smaller than that of a main portion of said filament part, having a cross sectional area which is smaller than that of a main portion of said filament part.

* * * * *